US008111847B2

(12) United States Patent
Lee et al.

(10) Patent No.: US 8,111,847 B2
(45) Date of Patent: Feb. 7, 2012

(54) ELECTRET MATERIALS, ELECTRET SPEAKERS, AND METHODS OF MANUFACTURING THE SAME

(75) Inventors: Shih-Yuan Lee, Taipei County (TW); Chih-Kung Lee, Taipei (TW); Wen-Ching Ko, Kaohsiung (TW); Jia-Lun Chen, Tainan (TW); Ing Yih Leu, Taipei (TW); Wen-Hsin Hsiao, Taoyuan County (TW); Wen-Jong Wu, Taipei (TW)

(73) Assignee: National Taiwan University (TW)

( * ) Notice: Subject to any disclaimer, the term of this patent is extended or adjusted under 35 U.S.C. 154(b) by 802 days.

(21) Appl. No.: 12/186,779

(22) Filed: Aug. 6, 2008

(65) Prior Publication Data

US 2009/0169036 A1 Jul. 2, 2009

Related U.S. Application Data

(60) Provisional application No. 61/035,300, filed on Mar. 10, 2008.

(30) Foreign Application Priority Data

Jan. 2, 2008 (TW) ..... 97100051 A

(51) Int. Cl.
*H04R 19/02* (2006.01)

(52) U.S. Cl. ..... 381/191

(58) Field of Classification Search ..... 381/191
See application file for complete search history.

(56) References Cited

U.S. PATENT DOCUMENTS 3,755,043 A * 8/1973 Igarashi et al. ..... 307/400
2009/0060233 A1 * 3/2009 Liou et al. ..... 381/191

FOREIGN PATENT DOCUMENTS

CN 1993000 7/2007

OTHER PUBLICATIONS

Office Action dated May 4, 2011 from corresponding Chinese Application No. 200910127378.7.

* cited by examiner

*Primary Examiner* — Alexander Ghyka
*Assistant Examiner* — Stanetta Isaac
(74) *Attorney, Agent, or Firm* — Lowe Hauptman Ham & Berner, LLP

(57) ABSTRACT

A speaker comprises at least one electrode electrically coupled with an audio signal input and a film comprising at least one electret layer. The film is configured to interact with the electrode in response to an audio signal supplied by the audio signal input and to vibrate to generate sound waves. The electret layer is formed from a polymer-containing solution.

21 Claims, 2 Drawing Sheets

| Materials (surface voltage) | 150um | 200um | 210um | 220um | 280um |
|---|---|---|---|---|---|
| COC (volt) | | -700 | | -880 | -1394 |
| Blended COC (volt) | -1267 | -1965 | -1996 | | |

n=5~10
Y=OH, $NH_2$ n=5~10
Y=OH, $NH_2$

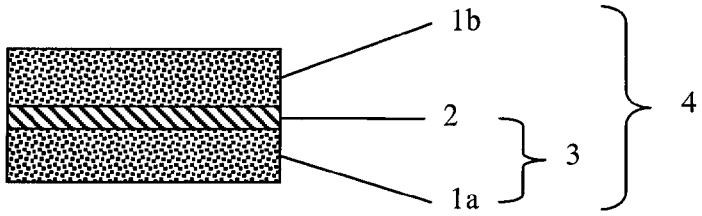
Fig. 4
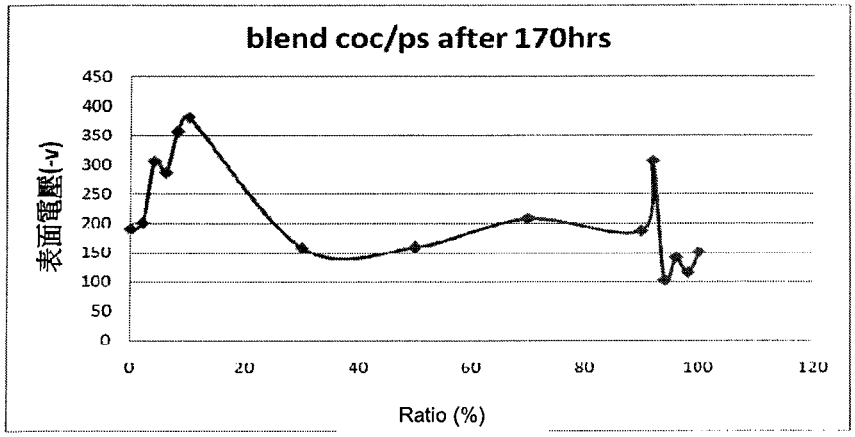
Fig. 5
| Materials (surface voltage) | 150um | 200um | 210um | 220um | 280um |
|---|---|---|---|---|---|
| COC (volt) | | -700 | | -880 | -1394 |
| Blended COC (volt) | -1267 | -1965 | -1996 | | |
Fig. 6

ELECTRET MATERIALS, ELECTRET SPEAKERS, AND METHODS OF MANUFACTURING THE SAME

BACKGROUND OF THE INVENTION

1. Field of the Invention

This invention relates to electret materials, and more particularly, to an electret speaker and a method of manufacturing the same.

2. Background of the Invention

An electrostatic speaker operates on the principle of Coulomb's law that two conductors with equal and opposite charge may generate a push-pull force between them. The push-pull electrostatic force may cause vibration of a diaphragm, and thereby generating sound. An electrostatic speaker may typically include two porous electrodes and a diaphragm placed between the electrodes to form a series of capacitors. The electrodes and the diaphragm may be separated by air gaps to provide space for the diaphragm to vibrate. The diaphragm is usually thin and light, and thus making the electrostatic speaker superior to other types of speakers, such as dynamic, moving-coil or piezoelectric speakers, with respect to its transition response, expansion capability in high frequency, smoothness of sound, acoustic fidelity and low distortion.

With the simple structure, electrostatic speakers may be manufactured in various sizes to accommodate increasing demand for small and thin electronic devices. However, a conventional electrostatic speaker requires a DC-DC converter to provide high voltage to the speaker. Considering the size, cost and power consumption of DC-DC converters, electret materials have been developed to replace DC-DC converters. An exemplary electret speaker is illustrated in FIG. 1, which may include porous electrodes 6*a* and 6*b*, and a diaphragm 4. The electrodes 6*a* and 6*b* may have a number of openings 61*a* and 61*b* on each electrode having a porosity of at least 30 percent. The electrodes 6*a* and 6*b* may be made of metals or plastic materials coated with a conductive film. The openings 61*a* and 61*b* may be provided for allowing sound waves to pass through. The diaphragm 4 may include a conductive layer 2 sandwiched between electret layers 1*a* and 1*b*. The electret layers 1*a* and 1*b* may contain either positive charges or negative charges. The electrodes 6*a* and 6*b*, and diaphragm 4 may be held in place by holding members 5*a* and 5*b*. The holding members 5*a* and 5*b* may be made of insulating materials. The electrodes 6*a* and 6*b* are separated from the diaphragm by insulating elements 51*a*, 51*b*, 61*a* and 61*b*. In operation of an electret speaker, each signal source 7*a* and 7*b* outputs an equal and opposite alternating signal to the electrodes 6*a* and 6*b* via conductive lines 8*a* and 8*b*. The signals cause a time-varying electric field to develop between the electrodes 6*a* and 6*b* and the electret layers 1*a* and 1*b*, thus resulting in a push-pull force. The push-pull force may cause the diaphragm 4 to vibrate. The resultant sound waves may pass through holes 61*a* and 61*b* to generate sound.

However, for an electret speaker to enhance its acoustic fidelity and low distortion, it requires an electret material with excellent charge storage stability and also a delicate process to fabricate a thin electret-metal-electret structure. It is known that fluorine-containing polymers, such as poly(thtrafluoroethylene) (PTFE), and fluorinated ethylene propylene (FEP), may have superior capability of electric charge storage. However, these materials may not adhere well to metals and are not suitable for being fabricated into a thin-film structure. Some fluorine-containing solutions such as CYTOP from Asahi Company and Teflon AF 1600 from Dupont Company, are expansive and not suitable for fabrication of diaphragms due to their machining property. As for other types of polymer electrets, such as polystyrene (PS), polycarbonate (PC), polyvinyl chloride (PVC), polymethylmethacrylate (PMMA), it is known that they may possess charge storage capability and may be dissolved in solvents, such as toluene, xylene or p-xylene. High density polyethylene (HDPE), polypropylene (PP) may be dissolved in p-xylene at a temperature of about 120° C. Polyimide (PI) and polyetherimide (PEI) may be dissolved in N-Methylpyrrolidone (NMP) or Dimethyformamide (DMF). In 1997, it was discovered that cyclic olefin copolymer (COC) possesses better electret and water-repellant property. Also COC may be dissolved in toluene, xylene and p-xylene to form a polymer solution. These polymer solutions mentioned above may be applied to fabricate single-sided diaphragms due to its superior machining property. However, their charge storage capability is not good enough for electret speakers and they may have adhesion issues on forming an electret-metal-electret structure.

BRIEF SUMMARY OF THE INVENTION

One example consistent with the invention provides a speaker which comprises at least one electrode electrically coupled with an audio signal input and a film comprising at least one electret layer. The film is configured to interact with the electrode in response to an audio signal supplied by the audio signal input and to vibrate to generate sound waves. The electret layer is formed from a polymer-containing solution.

In another example consistent with the invention, an electret material comprises a layer formed from a polymer-containing solution. The polymer-containing solution comprises a blended polymer solution containing at least two polymer materials.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended, exemplary drawings. It should be understood, however, that the invention is not limited to the precise arrangements and instrumentalities shown.

In the drawings:

FIG. 4 shows a sectional view of portions of an electret speaker in examples in consistent with the present invention;

FIG. 5 is a chart showing surface voltage of a blend of cyclic olefin copolymer and polystyrene; and FIG. 6 is a table illustrates surface charges of cyclic olefin copolymer and blended cyclic olefin copolymer in different thickness.

DETAILED DESCRIPTION OF THE INVENTION

The present invention is related to an electret material that comprises a layer formed from a polymer-containing solution. The polymer-containing solution may comprise a blended polymer solution containing at least two polymer materials. The polymer-containing solution may comprises at least one of cyclic olefin copolymer (COC), polystyrene (PS), polycarbonate (PC), polymethylmethacrylate (PMMA), polyvinyl chloride (PVC), (n+1)-hydroxy-alkanoic acid, (n+1)-amino-alkanoic acid, HO—$(CH_2)$n-COOH, 2,3-bis-(n-hydroxy-alkyloxy)-succinic acid, 2,3-bis-(n-amino-alkyloxy)-succinic acid, polyimide (PI), polyetherimide (PEI), high density polyethylene (HDPE), polypropylene (PP), and (n+1)-triazol-alkanoic acid, and 2,3-bis-(n-triazol-alkyloxy)-succinic acid, or in a dissolved or liquid form. In addition, the polymer-containing solution comprises at least one of tetrahydrofuran (THF), toluene, xylene, p-xylene, dichloromethane, chloroform, n-methylpyrrolidone, (NMP), and dimethylformamide (DMF) as a solvent.

Figure 1:
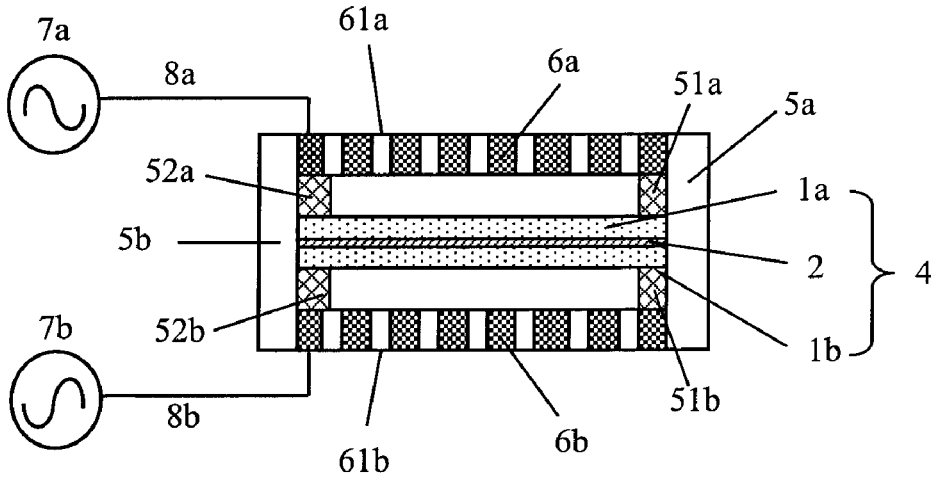
FIG. 1 is a sectional view of an exemplary electret speakers in prior art.
Figure 2:
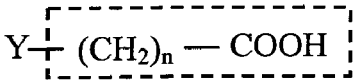
FIG. 2 is a formula of a hydrophobic hydrocarbon.

FIG. 2 shows a formula of a long-chain hydrophobic hydrocarbon. The hydrocarbon may have a highly polar carboxylic acid ground [—COOH] at one end. At the other end, it may be hydroxyl functional group or amine functional group. As a result, (n+1)-hydroxy-alkanoic acid or (n+1)-amino-alkanoic acid may be generated. In a first example consistent with the present invention, the blended polymer solution may contain hydroxyl acid compounds such as [HO—$(CH_2)$n-COOH], n=7, and cyclic olefin copolymer (COC). Specifically, the hydroxyl acid compound with a concentration of 1-10000 ppm by weight may be dissolved in THF (tetrahydrofuran) solution to generate solution A1. COC with a concentration of 0.1-15 weight percent may be dissolved in a solvent, such as toluene, xylene or p-xylene, to generate solution B1. In one example, COC may be at least one of TOPAS COC family, including but not limited to grades 8007, 6013, 5013 and 6017. The solutions A1 and B1 are mixed with a certain ratio so that the solution A1 has about 0.01-300000 ppm by weight to the resultant blended polymer solution.

In a second example consistent with the present invention, the blended polymer solution may contain hydroxyl acid compounds, such as [HO—$(CH_2)$n-COOH], n=7, and at least one of polystyrene (PS), polycarbonate (PC), polyvinyl chloride (PVC) and polymethylmethacrylate (PMMA). Specifically, the hydroxyl acid compound with 1-10000 ppm may be dissolved in, for example, dichloromethane or chloroform solution to generate solution A2. Polymers, such as polystyrene (PS), polycarbonate (PC), polyvinyl chloride (PVC), or polymethylmethacrylate (PMMA), with 0.1-10 weight percent may be dissolved in a solvent to form solutions B2-1, B2-2, B2-3 and B2-4. In one example, the solvent may be chloroform. The solution A2 may be mixed with B2-1, B2-2, B2-3 or B2-4 to a certain ratio so that the solution A2 has about 0.01-300000 ppm by weight to the resultant blended polymer solution.

Figure 3:
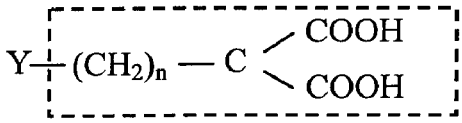
FIG. 3 is a formula of a hydrophobic hydrocarbon.

FIG. 3 shows the formula of a long-chain hydrophobic hydrocarbon. The hydrocarbon has two highly polar carboxylic acids [—COOH] at one end. At the other end, it may have hydroxyl functional group or amine functional group. As a result, 2,3-bis-(n-hydroxy-alkyloxy)-succinic acid and 2,3-bis-(n-amino-alkyloxy)-succinic acid may be generated. In a third example consistent with the present invention, the blended polymer solution may contain at least one of 2,3-bis-(n-hydroxy-alkyloxy)-succinic acid and 2,3-bis-(n-amino-alkyloxy)-succinic acid. 2,3-bis-(n-hydroxy-alkyloxy)-succinic acid or 2,3-bis-(n-amino-alkyloxy)-succinic acid with 1-10000 ppm by weight which may be dissolved in a solvent to generate solution A3. In one example, the solvent may be tetrahydrofuran, dichloromethane or chloroform. The solution A3 may be mixed with B1, B2-1, B2-2, B2-3 or B2-4 to a certain ratio so that the solution A3 has about 0.01-300000 ppm by weight to the resultant blended polymer solution.

In a fourth example consistent with the present invention, the blended polymer solution may contain at least two different polymer solutions. COC with a concentration of 1-15 by weight percent may be dissolved a solvent to form solution A4. A different type of polymer materials, such as polystyrene (PS) with a concentration of 1-25 by weight percent may be dissolved in a solvent to form solution B4. In one example, the solvent may be at least one of toluene, xylene and p-xylene. The solutions A4 and B4 are mixed with an appropriate ratio to generate the resultant blended solution. After a dry process and a corona charge process, it is observed that the surface voltage of the blended polymer increases in comparison with the surface voltage of the original polymers. FIG. 5 is a chart showing surface voltage of a blend of cyclic olefin copolymer and polystyrene. As shown in FIG. 5, the surface voltage of the blended COC/PS in a 85/15 or 15/85 ratio increases at least 190%. It is observed that the blended polymer provides crystallization interfaces and thus improving the charge storage capability and stability.

Similar to the fourth example, in a fifth example, at least one of polycarbonate (PC), polymethylmethacrylate (PMMA) and polyvinyl chloride (PVC) may be dissolved in a solvent, such as toluene, xylene and p-xylene. In addition, at least one of polyethylene (PE) and polypropylene (PP) may be dissolved in p-xylene at a temperature of about 120° C. These solutions may be mixed with an appropriate ratio to generate the resultant blended solution. Similar to the fourth example, in a sixth example, polyimide (PI) and polyetherimide (PEI) may be dissolved in a solvent such as N-Methylpyrrolidone (NMP) or Dimethylformamide (DMF). These solutions may be mixed with an appropriate ratio to generate the resultant blended solution. In a seventh example consistent with the present invention, the polymer solutions mentioned in the fourth, fifth, sixth or seventh examples may farther comprise highly polar carboxylic acids [—COOH] to improve the electret property. In a eighth example, the polymer solutions mentioned in the fourth, fifth and sixth examples may be formed on an non-woven material, such as polypropylene (PP), poly(ethylene terephthalate) (PET), nylon, blends of polypropylene (PP) and nylon or blends of polypropylene (PP) and poly(ethylene terephthalate) (PET). In a ninth example consistent with the present invention, the polymer solutions mentioned in the fourth, fifth, sixth or seventh examples may further include nanometer-scale particles or micrometer-scale fibers. In one example, the particles or fibers may be at least one of poly(ethylene terephthalate) (PET), poly tetrafluoroethylene (PTFE), fluorinated ethylene propylene (FEP), silicon dioxide, aluminum oxide, and high density polyethylene (HDPE).

To fabricate an electret layer, the blended solution as mentioned above may be processed by at least one of a spraying-coating, spin-coating, screen-printing and scraping process to form a wet film. The wet film is then dried in an appropriate temperature. During the drying process, the polymers and highly-polar compounds may form a self-assembling structure which provides holes in the range of nanometer to micrometer scale. Such a structure may increase electret area of the blended polymers. In addition, the electret property of the blended polymers may be improved by a corona charge process. In one example, the electret property of COC may be improved up to 140% as shown in FIG. 6. An electret layer such as 1*a* and 1*b* of FIG. 4 may be fabricated by a roll-to-roll process. The electret layer may be formed with a thickness between about 0.5~100 μm.

Referring to FIG. 4, a film 4 comprises two electret layers 1*a* and 1*b* and a conductive layer 2 placed between the electret layers 1*a* and 1*b*. The electret layers may be made in accordance with the process mentioned above. The conductive layer 2 may be made of gold, silver, aluminum, copper, chromium, platinum, indium tin oxide (ITO), silver paste, carbon paste or other conductive materials. The conductive layer 2 may be coated on the electret layer 1*a* by at least one of a spraying-coating, spin-coating, sputtering, evaporation, electroplating and screen-printing process to form structure 3. In one example, an e-beam evaporator is used to evaporate the metal layer onto the electret layer. The electret layer 1*b* is formed on the structure 3 through a vacuum thermal compression, mechanical compression or roll-to-roll process to form an electret-metal-electret film. A corona charge process may increase charge storage stability of the film 4. In this regard, the film 4 may be applied as a diaphragm used with, for example, an electret speaker. In one example, an electrostatic speaker comprises a film 4 and two electrodes which are electrically coupled with an audio signal input. The electrodes have openings for allowing the sound waves to pass through the openings. The film 4 is sandwiched between the electrodes with an air gap between each of the electrodes and the film 4. The film 4 may be an actuator remotely coupled with and insulated from the electrode to interact with the electrode in response to an audio signal from the audio signal input and to vibrate to generate sound waves.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. A speaker comprising:

at least one electrode electrically coupled with an audio signal input;

a film comprising at least one electret layer, the film being configured to interact with the electrode in response to an audio signal supplied by the audio signal input and to vibrate to generate sound waves, wherein the electret layer is formed from a polymer-containing solution which includes a polymer with a surfactant mixed therein, wherein the polymer comprises at least one of cyclic olefin copolymer (COC), polystyrene (PS), polycarbonate (PC), polymethylmethacrylate (PMMA), polyvinyl chloride (PVC), polyimide (PI), polyetherimide (PEI), high density polyethylene (HDPE), polypropylene (PP), and wherein the surfactant comprises at least one of (n+1)-hydroxy-alkanoic acid, (n+1)-amino-alkanoic acid, HO—$(CH_2)$n-COOH, 2,3-bis-(n-hydroxy-alkyloxy)-succinic acid, 2,3-bis-(n-amino-alkyloxy)-succinic acid, (n+1)-triazol-alkanoic acid, and 2,3-bis-(n-triazol-alkyloxy)-succinic acid.

2. The speaker of claim 1, wherein the polymer-containing solution further comprises at least one of tetrahydrofuran (THF), toluene, xylene, p-xylene, dichloromethane, chloroform, n-methylpyrrolidone (NMP), and dimethylformamide (DMF) as a solvent.

3. The speaker of claim 1, wherein the film contains self-assembling structure providing holes in the range of nanometer to micrometer scale.

4. The speaker of claim 1, wherein the film further comprises a conductive layer.

5. The speaker of claim 1, wherein the electret layer is formed via at least one of a spraying-coating, spin-coating, screen-printing, and scraping process.

6. The speaker of claim 1, wherein the electret layer is formed with a thickness between about 0.5~100 μm.

7. The speaker of claim 1, wherein the film is an actuator remotely coupled with and insulated from the electrode to allow the actuator to vibrate in relation to the electrode.

8. The speaker of claim 1, wherein the at least one electrode comprises two electrodes that sandwich the film between the two electrodes with an air gap between the electrodes and the film.

9. The speaker of claim 1, wherein the film comprises an electret-metal-electret structure.

10. The speaker of claim 1, wherein the at least one electrode has openings for allowing the sound waves to pass through the openings.

11. The speaker of claim 1, wherein the speaker is an electrostatic push-pull speaker.

12. The speaker of claim 1, wherein the electret layer is formed on a non-woven material.

13. The speaker of claim 12, wherein the non-woven material comprises at least one of polypropylene (PP), poly(ethylene terephthalate) (PET), and nylon.

14. The speaker of claim 1, wherein the electret layer comprises nanometer-scale particles or micrometer-scale fibers.

15. The speaker of claim 14, wherein the nanometer-scale particles or micrometer scale fibers comprise at least one of Poly(ethylene terephthalate) (PET), poly tetrafluoroethylene (PTFE), fluorinated ethylene propylene (FEP), silicon dioxide, aluminum oxide, and high density polyethylene (HDPE).

16. The speaker of claim 1, wherein the surfactant comprises $$Y—(—CH_2)_n—COOH,$$

in which

Y is OH or $NH_2$; and n is an integer ranging from 5 to 10.

17. The speaker of claim 1, wherein the surfactant comprises $$Y—(—CH_2)_n—(COOH)_2,$$

in which

Y is OH or $NH_2$; and n is an integer ranging from 5 to 10.

18. An electret material comprising a layer formed from a polymer-containing solution, wherein the polymer-containing solution comprises a polymer material with a surfactant material mixed therein, wherein the polymer material comprises at least one of cyclic olefin copolymer (COC), polystyrene (PS), polycarbonate (PC), polymethylmethacrylate (PMMA), polyvinyl chloride (PVC), polyimide (PI), polyetherimide (PEI), high density polyethylene (HDPE), and polypropylene (PP), and wherein the surfactant material comprises at least one of (n+1)-hydroxy-alkanoic acid, (n+1)-amino-alkanoic acid, HO—$(CH_2)$n-COOH, 2,3-bis-(n-hydroxy-alkyloxy)-succinic acid, 2,3-bis-(n-amino-alkyloxy)-succinic acid, (n+1)-triazol-alkanoic acid, and 2,3-bis-(n-triazol-alkyloxy)-succinic acid.

19. The electret material of claim 18, wherein the polymer-containing solution further comprises at least one of tetrahydrofuran (THF), toluene, xylene, p-xylene, dichloromethane, chloroform, n-methylpyrrolidone, (NMP), and dimethylformamide (DMF) as a solvent.

20. The electret material of claim 18, wherein the surfactant material comprises $$Y—(—CH_2)_n—COOH,$$

in which

Y is OH or $NH_2$; and n is an integer ranging from 5 to 10.

21. The electret material of claim 18, wherein the surfactant material comprises $$Y—(—CH_2)_n—(COOH)_2,$$

in which

Y is OH or $NH_2$; and n is an integer ranging from 5 to 10.

* * * * *